US011846301B2

(12) United States Patent
Sullivan et al.

(10) Patent No.: US 11,846,301 B2
(45) Date of Patent: Dec. 19, 2023

(54) ALIGNING A CENTERLINE OF A MOTOR SHAFT IN A FAN ASSEMBLY

(71) Applicant: TRANE INTERNATIONAL INC., Davidson, NC (US)

(72) Inventors: Ryan Sullivan, La Crosse, WI (US); Joseph R. Orr, La Crosse, WI (US); Brian F. Long, Lexington, KY (US); Daniel T. Niblick, Lexington, KY (US)

(73) Assignee: TRANE INTERNATIONAL INC., Davidson, NC (US)

( * ) Notice: Subject to any disclaimer, the term of this patent is extended or adjusted under 35 U.S.C. 154(b) by 711 days.

(21) Appl. No.: 15/458,725

(22) Filed: Mar. 14, 2017

(65) Prior Publication Data

US 2017/0268534 A1 Sep. 21, 2017

Related U.S. Application Data

(60) Provisional application No. 62/308,668, filed on Mar. 15, 2016.

(51) Int. Cl.
*F04D 29/60* (2006.01)
*F04D 29/62* (2006.01)
(Continued)

(52) U.S. Cl.
CPC ..... *F04D 29/601* (2013.01); *F04D 25/02* (2013.01); *F04D 29/053* (2013.01); *F04D 29/626* (2013.01)

(58) Field of Classification Search
CPC .... F04D 29/601; F04D 29/626; F04D 29/053; F04D 29/624; F04D 29/646; F04D 29/60;
(Continued)

(56) References Cited

U.S. PATENT DOCUMENTS 3,515,498 A * 6/1970 Akira ..... F04D 17/165 415/219.1
4,699,341 A * 10/1987 Ponticelli ..... B60K 35/00 248/27.1
(Continued)

FOREIGN PATENT DOCUMENTS

CN 201515285 U 6/2010
CN 202946455 U * 5/2013
(Continued)

OTHER PUBLICATIONS

Extended European Search Report, European Patent Application No. 17161095.9, dated Aug. 7, 2017 (7 pages).

*Primary Examiner* — Nathan C Zollinger
(74) *Attorney, Agent, or Firm* — Hamre, Schumann, Mueller & Larson, P.C.

(57) ABSTRACT

Aligning a motor shaft in a fan assembly is described. Aligning a centerline of a motor shaft in a direct drive fan assembly includes selecting a motor from among a plurality of motors and matching a motor-plate from among a plurality of motor plates to the motor, the matched motor plate is based on the selected motor.
Aligning the centerline further includes creating, from the selected motor and the matching motor plate, a motor-plate assembly that has a resulting height, where the resulting height of the motor-plate assembly corresponds to a particular height of a direct drive fan assembly, and aligning the centerline of a motor shaft of the motor-plate assembly to the direct drive fan assembly, where the particular height of the direct drive fan assembly is constant.

17 Claims, 9 Drawing Sheets

(51) Int. Cl.
*F04D 25/02* (2006.01)
*F04D 29/053* (2006.01)

(58) Field of Classification Search
CPC ..... F04D 29/622; F04D 25/08; F04D 25/06; F04D 25/02; F04D 17/16; F16M 1/04; F16M 1/08; F04B 53/22
USPC .... 417/359, 360; 29/281.4, 281.1, 559, 434, 29/462; 248/188.2, 669, 670, 678
See application file for complete search history.

(56) References Cited

U.S. PATENT DOCUMENTS 6,450,782 B1 * 9/2002 Sakamoto ..... F04C 23/00 248/678
7,028,970 B1 * 4/2006 Wiseman ..... F16M 5/00 108/51.11
7,669,345 B2 * 3/2010 Cheng ..... B23Q 3/04 33/568
8,814,639 B1 * 8/2014 Mecozzi ..... F24F 7/06 454/238
9,677,782 B1 * 6/2017 Mecozzi ..... F04D 25/166
2009/0067945 A1 * 3/2009 Cheng ..... B23Q 16/007 409/227
2009/0191069 A1 * 7/2009 Dubensky ..... F04D 29/601 417/362
2011/0010961 A1 * 1/2011 Wehrheim ..... D06F 58/04 34/549
2015/0267713 A1 9/2015 Robinson et al.
2017/0268534 A1 * 9/2017 Sullivan ..... F04D 25/02

FOREIGN PATENT DOCUMENTS

CN 202946455 U 5/2013
CN 105003466 A 10/2015

* cited by examiner

ALIGNING A CENTERLINE OF A MOTOR SHAFT IN A FAN ASSEMBLY

FIELD

This disclosure relates generally to a fan assembly. More specifically, this disclosure relates to aligning a centerline of a motor shaft in a direct drive fan assembly.

BACKGROUND

A direct drive fan assembly has the motor directly driving a fan wheel and does not use belts and/or sheaves to drive the fan wheels. Direct drive fans may require a special type of motor that provides high torque at a low speed rpm. However, the motor for a direct drive fan assembly may be physically larger than a motor running at a faster rpm. That is, a direct drive fan assembly may have a large motor that runs slowly.

Direct drive fan assemblies may be complex with many different parts and/or parts with multiple attachment points (e.g., holes), which have many different variations to accommodate for changing the components of the direct drive fan assembly. Many different parts and attachment points can be combined to make many different variations for each part.

SUMMARY

This disclosure relates generally to a fan assembly. More specifically, this disclosure relates to aligning a centerline of a motor shaft in a direct drive fan assembly.

As different motors are changed within the direct drive fan assembly, the various motors may have different motor heights and the motor shaft may not properly align with a hub in the direct drive fan assembly. When the motor shaft does not align in the direct drive fan assembly, more components may need to be changed to accommodate the changed motor so as to properly align the motor shaft. This may cause more parts to be combined and/or changed throughout the direct drive fan assembly in order to correct alignment.

As disclosed herein, a method for aligning a centerline of a motor shaft in a direct drive fan assembly is disclosed. In an embodiment, the method for aligning a centerline of a motor shaft in a direct drive fan assembly includes selecting a motor from among a plurality of motors, and matching a motor plate from among a plurality of motor plates to the motor, the matched motor plate is based on the selected motor. The method includes creating, from the selected motor and the matching motor plate, a motor-plate assembly that has a resulting height, where the resulting height of the motor-plate assembly corresponds to a particular height of a direct drive fan assembly. The method further includes aligning the centerline of the motor-plate assembly to the direct drive fan assembly, where the particular height of the direct drive fan assembly is a constant height.

BRIEF DESCRIPTION OF THE DRAWINGS

Reference is now made to the drawings in which like reference numbers represent corresponding parts throughout.

DETAILED DESCRIPTION

A direct drive fan assembly has the motor directly driving a fan wheel and does not use belts and/or sheaves to drive the fan wheels. Direct drive fans may require a special type of motor that provides high torque at a low speed rpm. However, a motor for a direct drive fan assembly that operates at a lower rpm may be physically larger than a motor that normally operates at a faster rpm.

As different motors are changed within the direct drive fan assembly, the various motors may differ in height, which may not properly align the motor shaft in the direct drive fan assembly. When the motor shaft does not align in the direct drive fan assembly, more components need to be changed to accommodate for the changed motor so as to properly align the motor shaft. This may cause more parts to be combined and/or changed throughout the direct drive fan assembly in order to correct alignment.

As a result, direct drive fan assemblies may be complex with many different parts and/or parts with multiple attachment points to provide many different variations. For example, some parts may have a plurality of holes to enable parts to be installed in many different locations upon the assembly, which creates many different variations for each part. Many parts can cause complications when assembling a direct drive fan assemblies due to the combination of a large number of part types and multiple set of holes. The assembly can be further complicated when the fans are assembled incorrectly (e.g., incorrect part and/or hole attachments), which may force a rework of the fan and/or reassembly.

As disclosed herein, a method for aligning a centerline of a motor shaft in a direct drive fan assembly while minimizing components is described. Aligning the centerline of the motor shaft in the direct drive fan assembly includes changing only a motor and a corresponding motor-plate in the direct drive fan assembly, thereby reducing the number of components that are changed and/or replaced in the direct drive fan assembly. That is, the arrangement of the hub and the frame of the direct drive fan assembly and their sizing can remain unchanged, while a sizing of a motor and/or motor plate are changed. The motor and the motor plates can be reused and/or combined in various assemblies to fit a single fan assembly frame and/or fan.

By limiting the number of components (e.g., the motor and the motor-plate) that are changed in the direct drive fan assembly, changing motors in the direct drive fan assembly can be more efficient, less complex, and fewer parts may be manufactured which can lead to cost savings.

Figure 1:
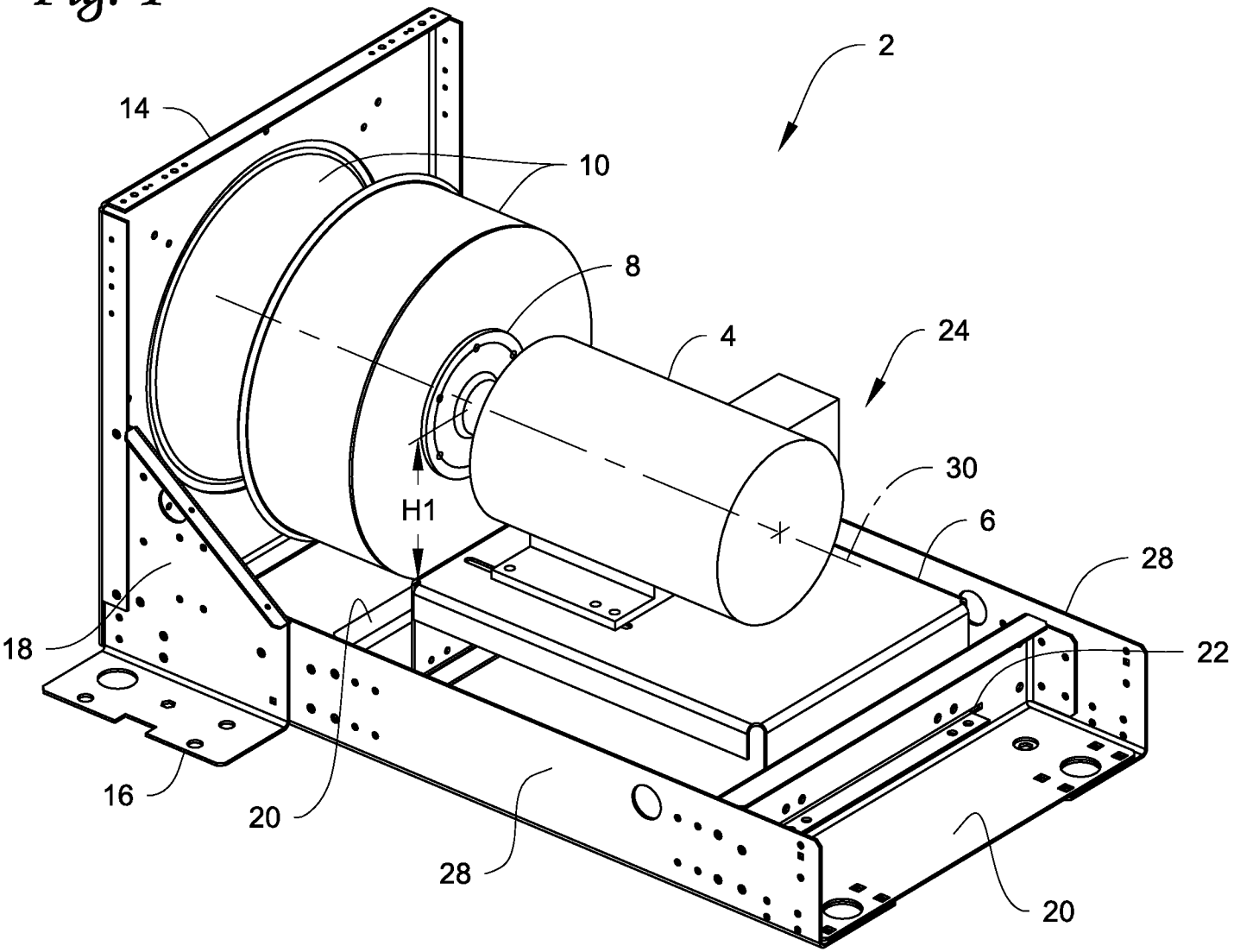
FIG. 1 illustrates a direct drive fan assembly with a motor-plate assembly, according to an embodiment of the disclosure.

FIG. 1 illustrates a direct drive fan assembly 2 with a motor-plate assembly, according to an embodiment of the disclosure. The direct drive fan assembly 2 includes isolator brackets 16, gussets 18, a motor supports 20, two rails 28, an inlet plate 14, a fan 10, and a hub 8, which form a fan assembly base. One end of isolator brackets 16 is connected to a side of the gussets 18 and other end of the isolator bracket 16 is connected to the inlet plate 14. The gussets 18 are also connected to the inlet plate 14. The inlet plate 14 is connected to a first end of the fan 10, while a second end of the fan 10 is connected to the hub 8. The fan 10 can have a plurality of blades (not shown) to blow air into the inlet plate 14 and across a motor 4. A second end of the gusset 18 is connected to the rail 28, and a motor support 20 connects, for example, perpendicularly to the rails 28. As illustrated in FIG. 1, two motor supports 20 are attached perpendicularly to the two rails 28. The motor supports 20 may each include a notch 22, described in detail further herein.

The direct drive fan assembly 2 further includes a motor-plate assembly 24. The motor-plate assembly 24 is created from a combination of the motor 4 and a motor plate 6. A motor 4 among a plurality of motors can be matched to a motor plate 6 among a plurality of motor plates, the combination of which can form a plurality of different motor-plate assemblies 24 with different heights. The motor-plate assembly 24 is mounted and/or attached on top of the motor supports 20 of the direct drive fan assembly 2.

The centerline 30 is the center of the motor shaft of the motor-plate assembly 24. As illustrated in FIG. 1, the motor shaft of the motor-plate assembly 24 goes along centerline 30, indicating the center of the motor shaft. The centerline 30 of the motor-plate assembly 24 can align with the hub 8 of the direct drive fan assembly 2 to connect the motor shaft to the hub 8. The direct drive fan assembly 2 includes a particular height H1 at which the direct drive fan assembly 2 is calibrated. The particular height H1 is the distance between the top of the motor supports 20 to the center of the hub 8 or other connection component for connection with the hub 8. For example, the particular height H1 can be calibrated based on a predetermined motor 4 size in the direct drive fan assembly 2. In an embodiment, the particular height H1 can be based on the centerline 30 of a motor shaft of a maximum sized motor 4 that may be intended to be connected to the hub 8. This is so that a particular fan assembly or the direct drive fan assembly 2 can accommodate the largest sized motor which would be used in the direct drive fan assembly 2; Different motor plates 6 may then be employed to provide any adjustment that may be needed when a smaller motor is used in the same type of direct drive fan assembly 2. In other words, H1 is a constant height based on the size of a predetermined motor 4 in the direct drive fan assembly 2. H1 is a constant height based on the size of the fan 8, and H1 will not change by changing the size of the motor 4. In some embodiments, the plurality of different motor-plate assemblies 24 with different respective motor 4 heights and/or motor plate 6 heights may align the centerline 30 of the motor with the particular height H1 of the direct drive fan assembly 2, as discussed further herein.

In an embodiment, each motor support 20 of the direct drive fan assembly 2 can include a notch 22 in the base frame 20. The notches 22 can be utilized to decrease a respective height of the motor-plate assembly 24 relative to the direct drive fan assembly 2. The notches 22 can be advantageous such that the motor-plate assemblies can be used across multiple fan assembly 2 sizes. The notches 22 can aid in positioning the motor-plate assembly 24 by properly aligning the centerline 30 of the motor shaft with the hub 8 of the direct drive fan assembly 2, as discussed further herein.

Figure 2B:
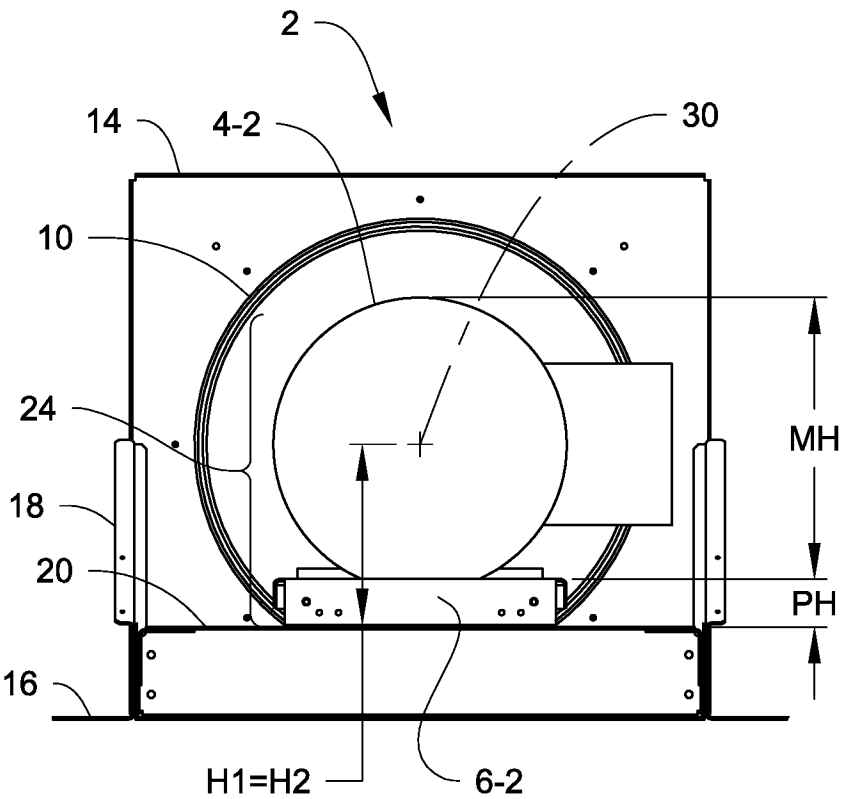
FIGS. 2A and 2B illustrate different configurations of motor-plate assemblies, according to an embodiment of the disclosure.
Figure 2A:
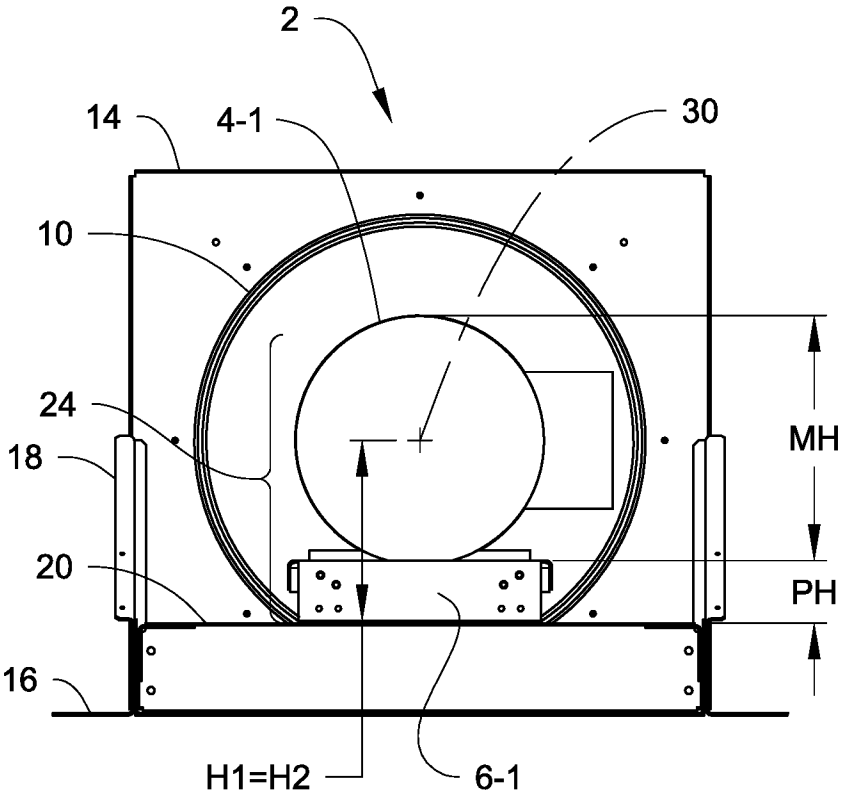
Figure 3B:
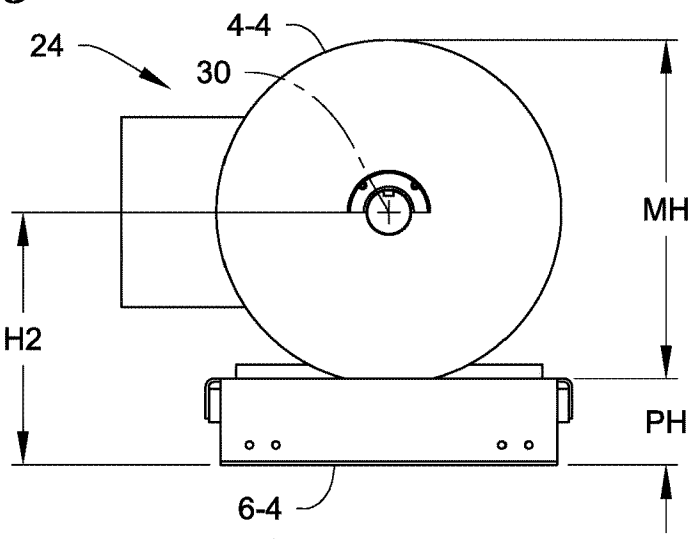
FIGS. 3A-3E illustrate a plurality of configurations of motors-plate assemblies, according to different embodiments of the disclosure.
Figure 3A:
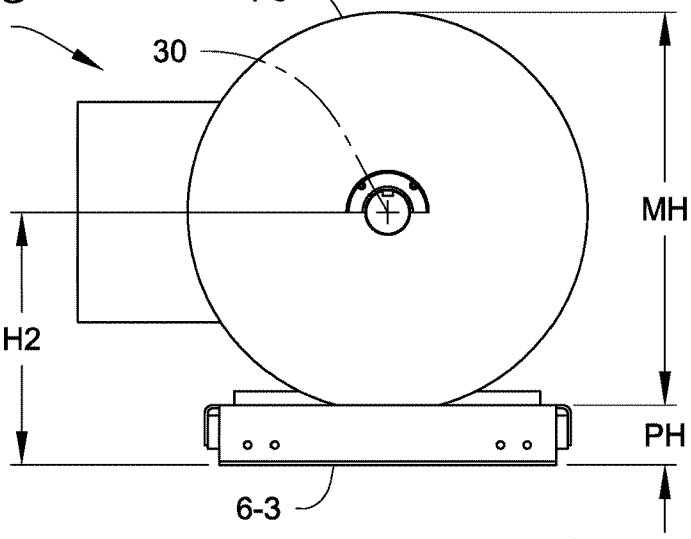
Figure 3E:
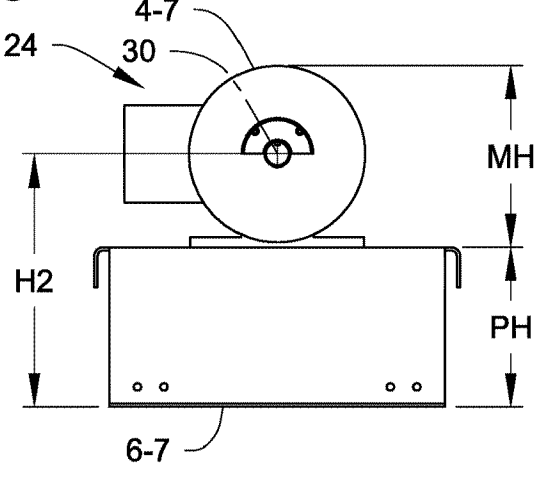
Figure 3D:
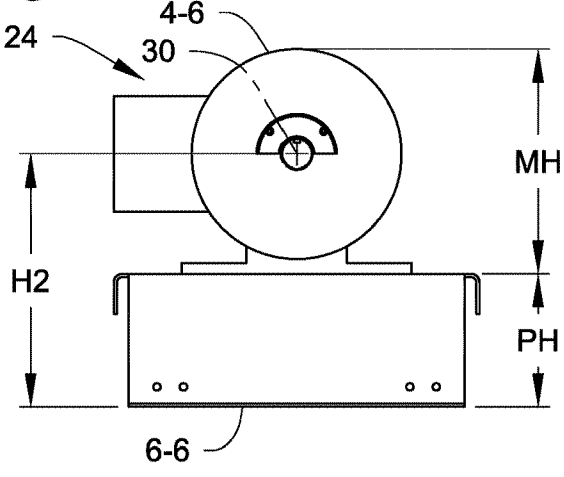
Figure 3C:
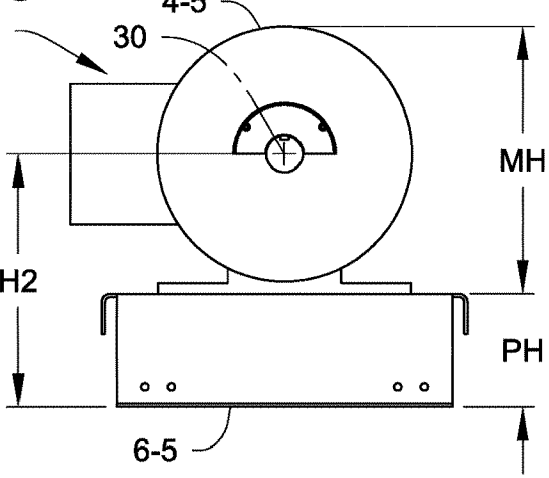

FIGS. 2A and 2B illustrate different configurations of motor-plate assemblies, according to an embodiment of the disclosure. For simplicity of the specification, identical features that were previously described will not be described again.

As described herein, each motor 4 can have a matching motor plate 6. The matching motor plate 6 is inversely related to the particular motor height of the motor 4. As illustrated in FIGS. 2A and 2B, a tall (e.g., larger) motor 4-2 is matched with a shorter (e.g., smaller) motor plate 6-2 in the direct drive fan assembly 2, while a short (e.g., smaller) motor 4-1 is matched with a tall (e.g., larger) motor plate 6-1. That is, a taller motor 4-2 with a taller motor height MH may be matched with a shorter motor plate 6-2, while a shorter motor 4-1 with a shorter motor height MH may be matched with a taller motor plate 6-1. A selected motor 4 will determine the particular matching motor plate 6. That is, the matching motor plate 6 is dependent upon the selected motor 4. For example, the matching motor-plate height PH is less than the motor-plate height PH in response to the different sized motors (e.g., 4-1, 4-2) with different respective motor heights MH.

Although each of the motor-plate assemblies 24 is a combination of different sized components (e.g., motor 4, motor plate 6), a resulting height H2 (shown in FIGS. 3A-3E) of the base of the motor plate to the centerline 30 of the shaft of the motor 4 for each embodiment, is equal to the particular height H1 (shown in FIG. 1) in the direct drive fan assembly 2 (e.g., H2=H1). While different motor-plate assemblies 24 may vary (e.g., different sized motors 4, different sized motor-plates 6), the motor-plate assemblies 24 are assembled such that the centerline 30 of the motor shaft will align and connect with the hub (e.g., 8 in FIG. 1) of the direct drive fan assembly 2. In other words, the particular height H1 of the direct drive fan assembly 2 is equal to the resulting height H2 of the motor-plate assembly 24 (e.g., H2=H1 as illustrated in FIGS. 3A-3E), thereby aligning the centerline 30 to the hub of the direct drive fan assembly 2. Thus, regardless of the motor 4 and/or the motor plate 6 changing in the direct drive fan assembly 2, the resulting height H2 of the motor-plate assembly 24 will equal the particular height H1 of the direct drive fan assembly 2. The motor shaft in various the motor-plate assembly 24 configurations will align to the direct drive fan assembly 2 for proper connection.

As described further herein, each resulting height H2 among the plurality of configurations of motor-plate assemblies (e.g., 24) can align the centerline 30 with the direct drive fan assembly 2.

FIGS. 3A-3E illustrate a plurality of configurations of motors-plate assemblies 24, according to different embodiments of the disclosure.

As illustrated in FIGS. 3A-3E, a plurality of motor-plate assemblies 24 with various motors 4-3, 4-4, 4-5, 4-6, 4-7 (generally referred to herein as motors 4) are depicted with various matching motor-plates 6-3, 6-4, 6-5, 6-6, 6-7, etc. (generally referred to herein as motor-plates 6). The combination of one of the motors 4 and one of the motor plates 6 form a unique motor-plate assembly 24.

As previously described herein, the motor 4 height (e.g., MH in FIGS. 2A and 2B) and the matching motor plate 6 height (e.g., PH in FIGS. 2A and 2B) are inversely related. As illustrated in FIGS. 3A-3E, each of the plurality of motors 4 has a particular motor height MH that corresponds to a particular motor plate 6 with a different motor plate height PH. For instance, the taller the motor 4 (e.g., 4-3), the shorter the matching motor plate 6 (e.g., 6-3). Alternatively, the shorter the motor 4 (e.g., 4-7), the taller the matching motor plate 6 (e.g., 6-7).

The plurality of motor-plate assemblies 24 are formed from the various combinations between each of the motors 4 and matching motor-plates 6. However, each combination of the plurality of motor-plate assemblies 24 aligns the centerline 30 of the motor shaft with the direct drive fan assembly (e.g., 2 in FIGS. 1, 2A, and 2B). The motor-plate assembly 24 has a resulting height H2 of a distance from the centerline 30 of the motor shaft of the motor 4 to the base of the motor plate 6. That is, the distance from the centerline 30 of the motor shaft of the motor 4 to the base of the motor plate 6 defines the resulting height H2. As illustrated in FIGS. 3A-3E, although the combination of the overall motor height MH and the motor plate height PH may differ, each combination results in the same height H2, as discussed further below.

For example, a direct drive fan assembly 2 can have a particular height of H1, while a largest/tallest motor 4-3 can be measured from a matching motor plate 6-3 to the centerline 30 of the motor shaft, giving a resulting height of H2. H2 will equal H1. Additionally, or alternatively, a smallest motor 4-7 can be measured from a matching motor plate of 6-7 to the centerline 30 of the motor shaft, giving a resulting height of H2. H2 will equal H1. As such, multiple combinations of motors 4 and motor plates 6 can be assembled to create various motor-plate assemblies 24, each of which can align with the direct drive fan assembly for proper operation.

The alignment of the centerline 30 to the direct drive fan assembly can be advantageous such that when the motor 4 is replaced, only the motor 4 and/or the motor plate 6 may be replaced. The direct drive fan assembly 2 components (e.g., fan 10, hub 8, isolator bracket 16, motor supports 20, gusset 18, inlet frame 14, etc. shown in FIG. 1) maintain the same arrangement and same component sizing.

Figure 4A:
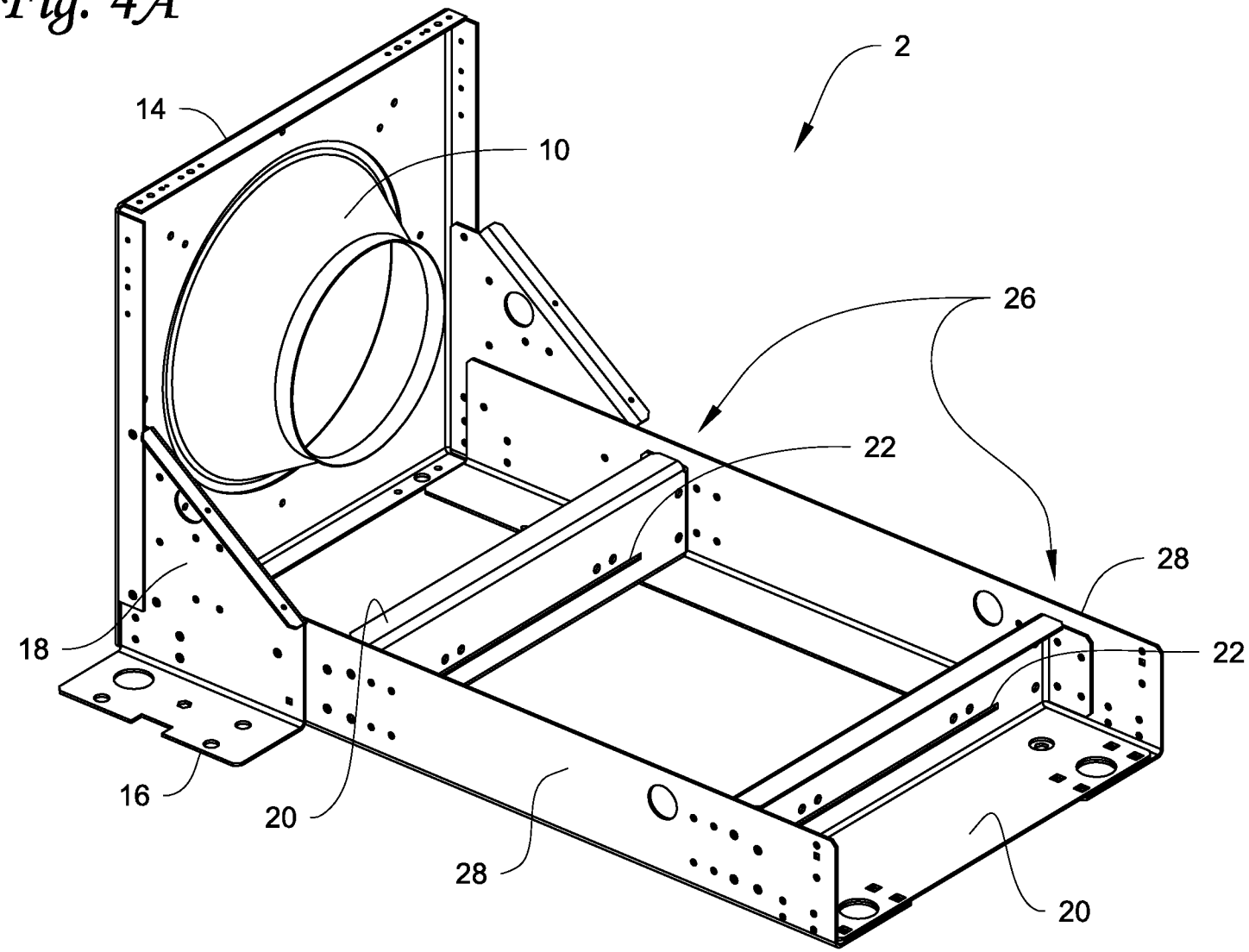
FIG. 4A illustrates a direct drive fan assembly frame, according to an embodiment of the disclosure.
Figure 4B:
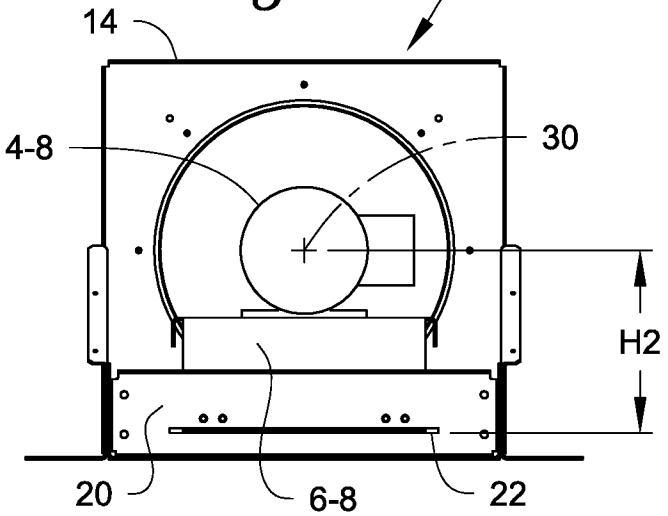
FIGS. 4B-4E illustrate a plurality of configurations of motors-plate assemblies, according to an embodiment of the disclosure.
Figure 4C:
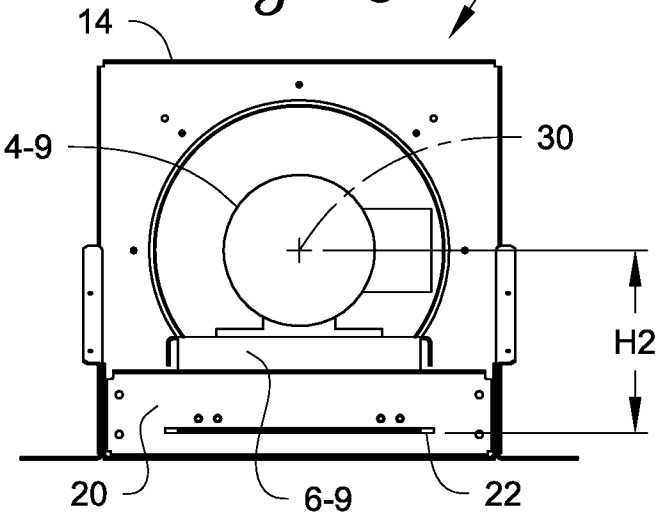
Figure 4D:
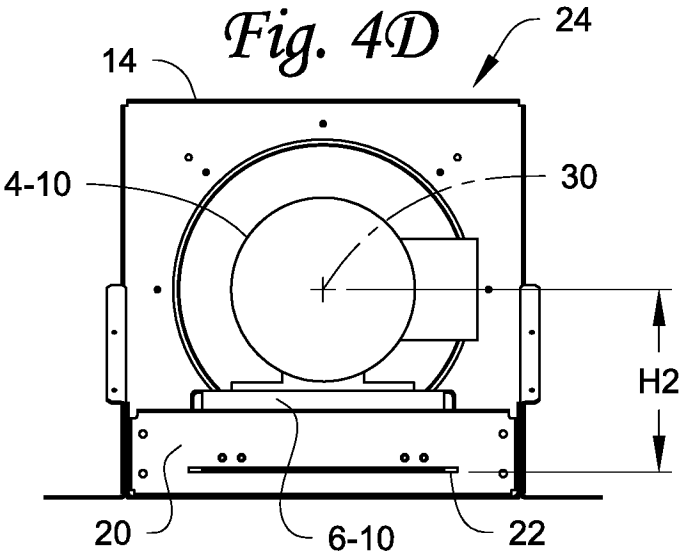
Figure 4E:
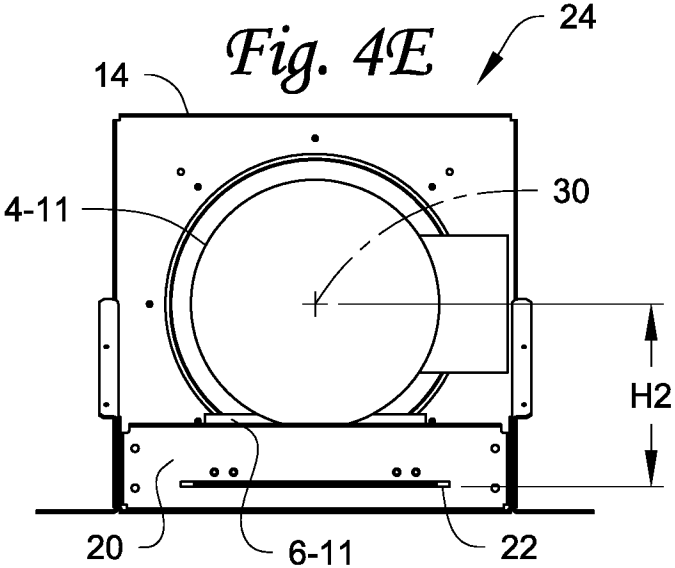
Figure 4F:
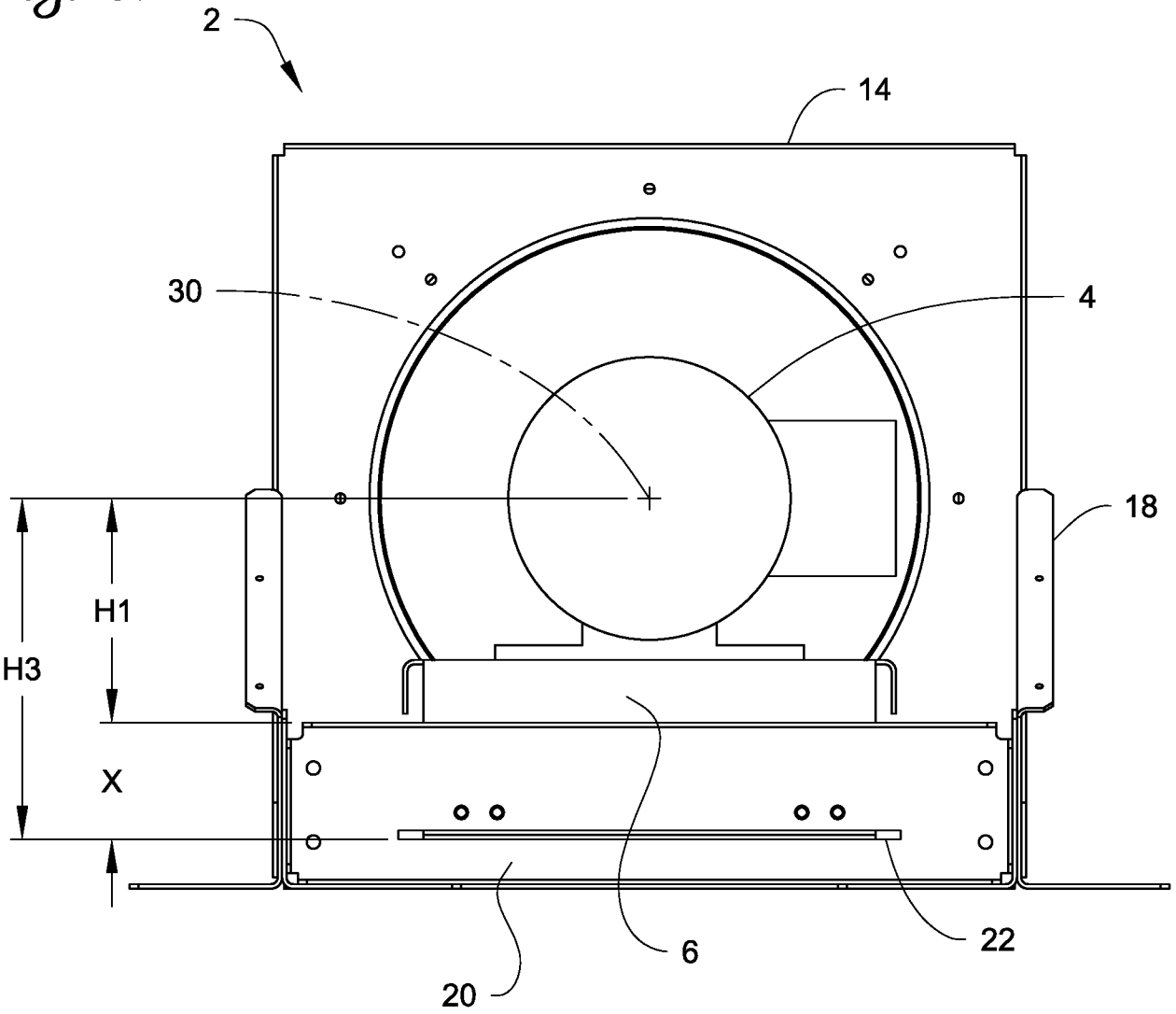
FIG. 4F illustrates notches in the motor supports of the direct drive fan assembly, according to an embodiment of the disclosure.

In some embodiments, a notch 22 in each motor supports 20 may be used to lower the motor-plate assembly 24 to aid in aligning the centerline 30 of the motor shaft with the hub of a relatively shorter direct drive fan assembly 2 and/or when the particular motor-plate assembly 24 exceeds a threshold height, as discussed further herein with respect to FIG. 4F.

FIG. 4A illustrates a direct drive fan assembly frame 2, according to an embodiment. A direct drive direct drive fan assembly 2 previously described herein is depicted without a motor-plate assembly 24 or a fan 10. In some embodiments, the notch 22 in each motor support 20 of a relatively short direct drive fan assembly 2 may be used to lower a motor-plate assembly 24 to align the centerline 30 in the short direct drive fan assembly 2, as described further herein with respect to FIG. 4F.

As shown in FIG. 4A, the other parts of the direct drive fan assembly 2 components remain assembled (e.g., unchanged) even when the motor 4 and motor plate 6, which form a motor-plate assembly 24, are changed. In other words, although a motor 4 and/or a motor plate 6 may be changed for a different motor-plate assembly 24, the other components of the direct drive fan assembly 2 remain in an assembled configuration in the direct drive fan assembly 2, and only the motor-assembly 24 is altered. For instance, the direct drive fan assembly frame 2 comprised of the fan 10, the inlet plate 14, the isolator brackets 16, the rail 28, the gusset 18, and the motor supports 20, remain assembled in the frame when a motor 4 is changed.

FIGS. 4B-4E illustrate a plurality of configurations of motors-plate assemblies 24, according to an embodiment. As illustrated in FIGS. 4B-4E, a plurality of motor-plate assemblies 24 combinations are depicted. For example, motor 4-8 may be matched with motor plate 6-8, which illustrates a small motor 4-8 matched with a tall motor plate 6-8.

Each of the combinations of the motor 4 and the motor plate 6 form a unique motor-plate assembly 24. Each of the motor-plate assemblies 24 has a resulting height H2, which is the sum from the base of the motor plate 6 to the centerline 30 of the motor 4. The predetermined particular height H1 of the direct drive fan assembly 2 is a constant distance (e.g., the center of hub 8 in FIG. 1 to top of the motor supports 20). As such, the resulting height H2 of the motor-plate assembly 24 is equal to the particular height H1 (H2=H1) such that the centerline 30 aligns with the hub of the direct drive fan assembly 2.

In an embodiment, the direct drive fan assembly 2 can receive the motor-plate assembly 24 on the placement area 26 of the direct drive fan assembly 2. The placement area 26 is on top of the motor supports 20 attached to the rails 28. The motor-plate assembly 24 can be securely attached to the placement area 26 via suitable attachments, bolts, screws, or the like, for example. Each of the motor-plate assemblies 24 illustrated in FIGS. 4B-4E can be placed on the placement area 26 of the direct drive fan assembly 2 of FIG. 4A, and each centerline 30 of the motor shaft of the motor-plate assembly would align with the direct drive fan assembly 2 in FIG. 4A for proper operation.

In some embodiments, the motor 4 may be changed to a different motor 4, such as for different torque requirements. When a motor 4 is changed in the motor-plate assembly 24, the height of the motor plate 6 may increase in response to a decreased motor 4 size. Alternatively, the height of the motor plate 6 may decrease in response to the motor 4 increasing in size (e.g., height). The corresponding motors 4 and plates 6 change inversely in response to the respective motor 4 size such that the centerline 30 of the motor shaft aligns with the direct drive fan assembly 2.

FIG. 4F illustrates a notch in each of the motor supports of the direct drive fan assembly, according to an embodiment of the disclosure.

Each notch 22 is a slot in a motor support 20 that enables the distance from the center of the hub to the top of the motor support 20 to be lowered (e.g., dropped), thereby increasing the height with the added distance X of the notch placement. Each notch 22 can receive a flange from the motor plate 6, such that the flanges of the motor plate 6 slide into the notches 22. Each flange of the motor plate 6 may be secured to the notch 22 with a bolt, screw, or like attachments.

The notches 22 can aid in properly aligning the centerline 30 of the motor shaft using various motors 4 matched to the motor plates 6. That is, different direct drive fan assemblies 2 may change the particular height H1. For instance, a shorter direct drive fan assembly 2 may be set to receive a short (e.g., small) motor 4, the motor 4 may be matched with the smallest motor plate 6. However, the resulting height H2 may still exceed the particular height H1 (e.g., H2>H1), thereby not allowing the motor 4 to be correctly aligned to a direct drive fan assembly 2. The motor-plate assembly 24 may exceed a threshold height such that even matching the motor 4 to a smallest motor plate 6 exceeds the particular height H1 of the direct drive fan assembly. In these instances, the notches 22 may be used to modify the particular height H1 to a modified height H3 that is equal to the sum of the original height of H1 and a distance X (e.g., H3=H1+X). For example, in a short direct drive fan assembly 2, the resulting height H2 of the motor-plate assemblies 24 as previously discussed with respect to FIGS. 3A-3E may not be equivalent to the particular height H1 of the short direct drive fan assembly 2 due to a lowering of the center of the hub of smaller (shorter) fan. A motor 4 with the shortest motor plate may still have a height greater than H1. To accommodate the short (e.g., smaller) direct drive fan assembly 2, the notches 22 may be used to modify the particular height H1 of the direct drive fan assembly and the resulting height H2 of the motor-plate assembly 24 to maintain the H1=H2 relationship.

As illustrated in FIG. 4F, the short direct drive fan assembly 2 can use the notches 22 to modify the required particular height H1. The modified particular height H3 of the direct drive fan assembly 2 can be the sum of a distance measured from the center of the hub 30 of the direct drive fan assembly 2 to the top of the motor support 20 (illustrated in FIG. 4F as H1, which is the original height as shown in FIG. 1) and a distance from the top of the motor support 20 to the notch 22 (illustrated in FIG. 4F as X) (e.g., H1+X=H3). Accordingly, the notches 22 lower the base of the motor-plate assembly 24 an additional distance X from its previous position where it was mounted and/or attached to the top of the motor supports 20. As such, the required height H2 of the motor-plate assembly 24 is measured from the notch 22 to the center of the hub 8 (H3) instead of from motor supports 20 to the center of the hub 8 (H1) as required in other embodiments when the base of the motor-plate assembly 24 was mounted to the top of the motor supports 20.

The notches 22 can be used to accommodate different fan sizes and/or changes of the motor 4 (e.g., size). Thus, when the distance from the center of a hub to the top of the motor support 20 of a direct drive fan assembly 2 changes due to a different fan size, the notches 22 can be used to lower the motor-plate assembly 24 to accommodate the particular fan sizes and motor 4 to properly align the centerline 30 of the motor shaft with the hub. The notches 22 can be advantageous such that the motor-plate assemblies 24 can be used across multiple fan assembly 2 sizes to keep the H1 and H2 relationship.

Alternatively, in some embodiments, an oversized motor that exceeds the centerline of the maximum motor 4 may utilize the notches 22 to lower the centerline 30 so as to align with the direct drive fan assembly 2. Although the notches 22 are illustrated in the motor support 20 of a short direct drive fan assembly, it will be appreciated that the use of the notch could apply to size changes on the motor plate assembly side.

It may be appreciated that the particular height H1 and the resulting height H2 are equal and still align the centerline 30 of the motor shaft with the direct drive fan assembly 2 even though measured from different reference points and minor variance from measuring may be present. That is, measuring from the top of the motor support 20 to the center of the hub (e.g., 8 in FIG. 1) to determine the particular height H1, or measuring from the notch 22 to the center of the hub to determine the modified particular height H3, may still be equivalent to the resulting H2 that is measured from the base of the motor plate 6 to the centerline 30 of the motor shaft. The minor variance that may be present between H2 and H1 (or H3) is deemed to be a deminimus amount and does not impede alignment.

Figure 5A:
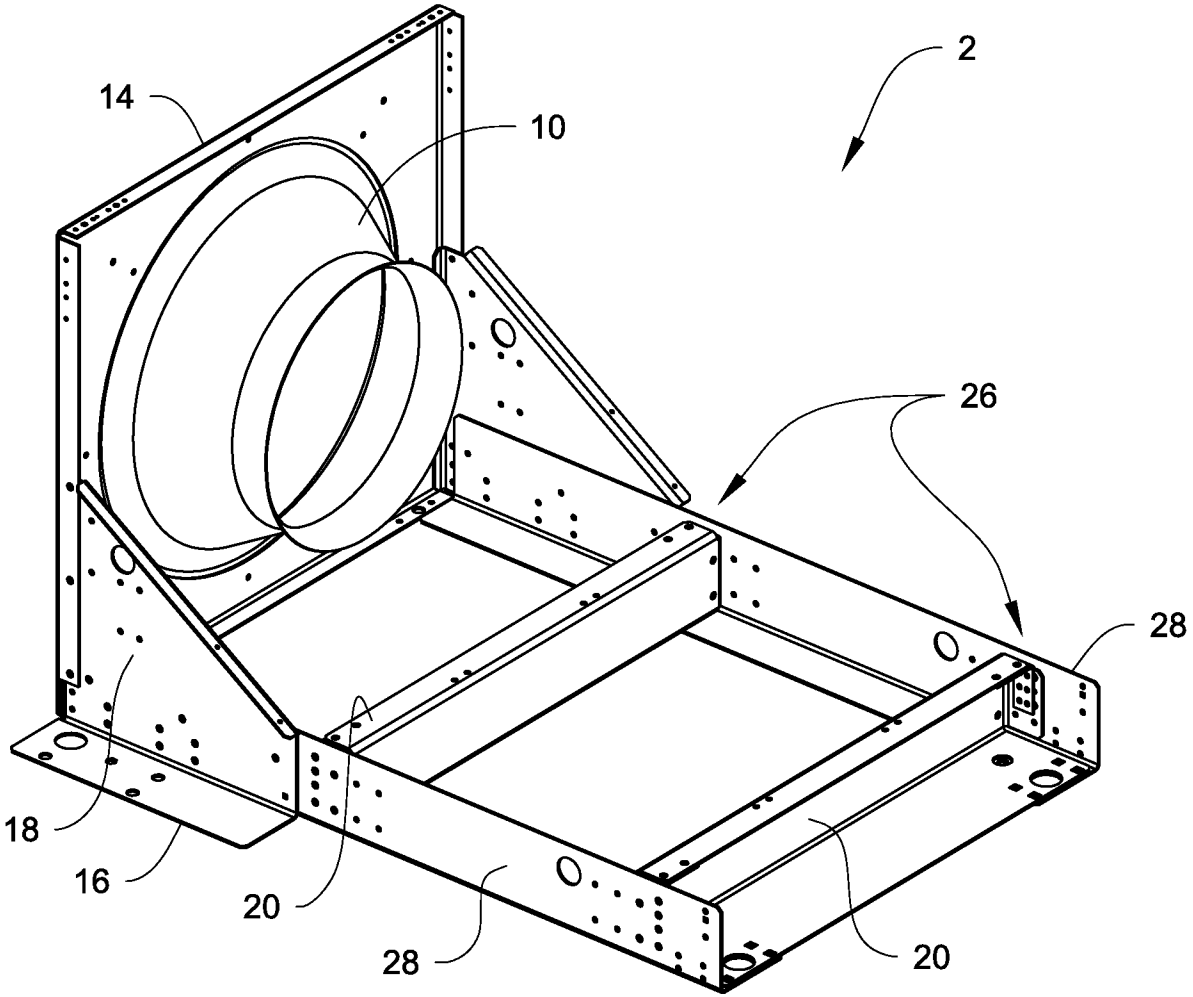
FIG. 5A illustrates a direct drive fan assembly frame, according to an embodiment of the disclosure.
Figure 5C:
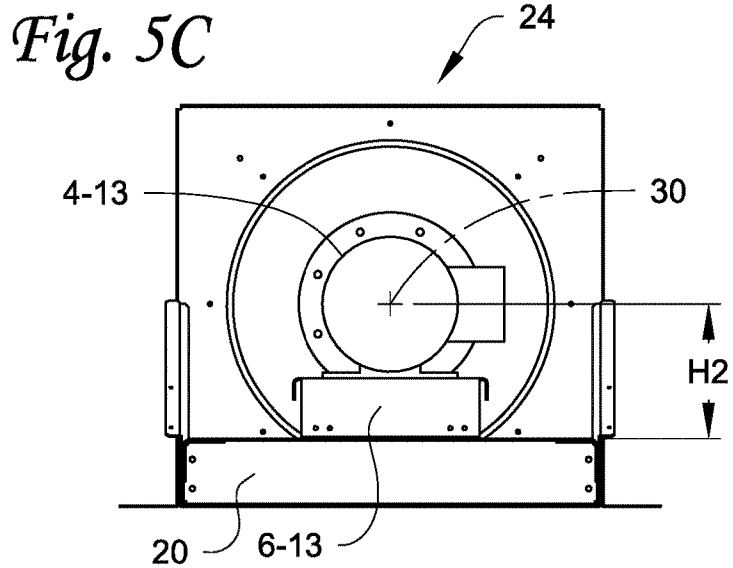
FIGS. 5B-5E illustrate another configuration of a plurality of configurations of motors-plate assemblies, according to a second embodiment of the disclosure.

FIG. 5A illustrates a direct drive fan assembly frame, according to an embodiment of the disclosure. A direct drive fan assembly 2 previously described herein is depicted without a motor-plate assembly 24. As previously described herein, in some embodiments, the motor supports 20 of the direct drive fan assembly 2 may include notches (e.g., 22 in FIG. 4F), which may be used to lower the motor-plate assembly 24 to accommodate a motor 4 in a shorter direct fan assembly 2, although the notches 22 may also be used in a taller (e.g., larger) direct drive fan assembly 2. The notches 22 can function to align the centerline (e.g., 30 in FIG. 1) with the hub of the direct drive fan assembly 2 as previously described herein.

Figure 5B:
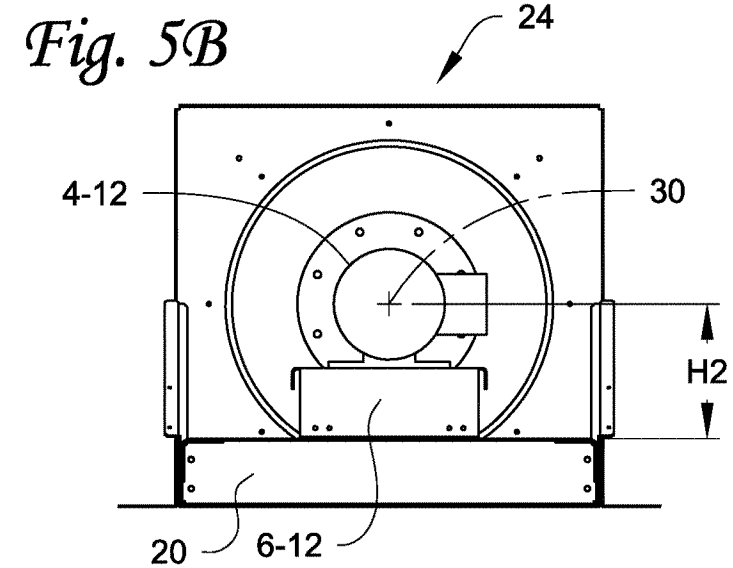
Figure 5E:
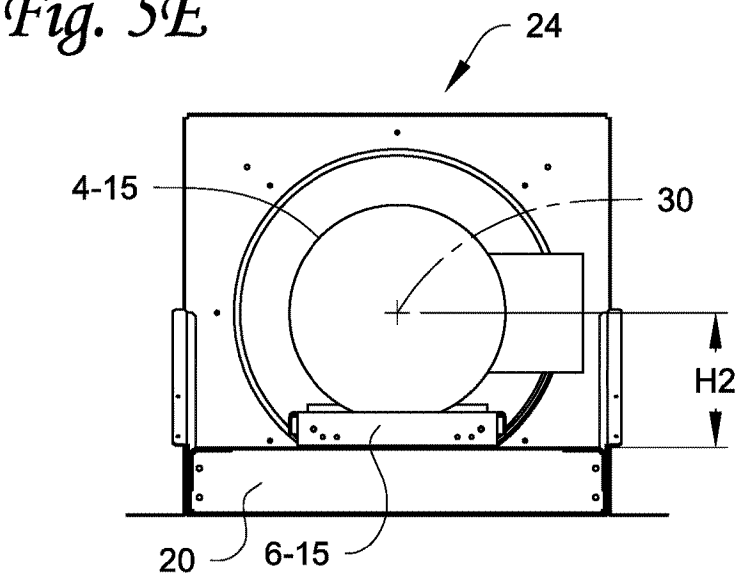
Figure 5D:
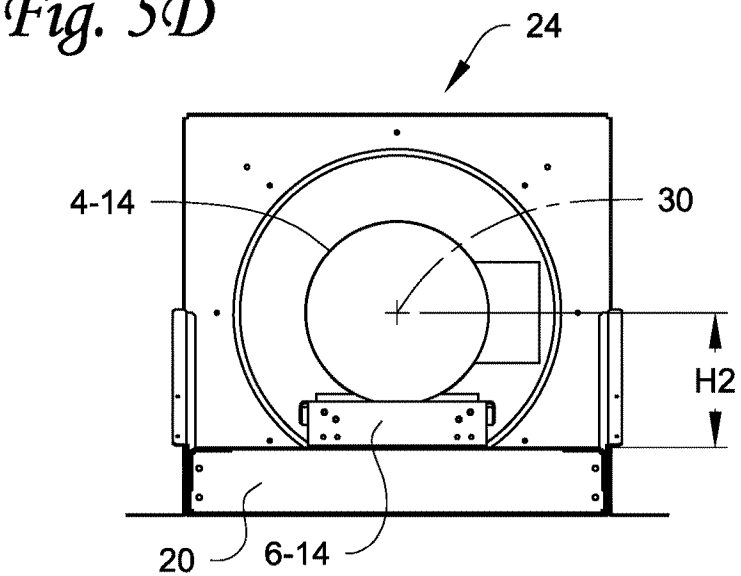

FIGS. 5B-5E illustrate another configuration of a plurality of configurations of motors-plate assemblies, according to a second embodiment of the disclosure. Similar to FIG. 4B, as illustrated in FIG. 5B, the motor 4 can be a particular motor from among a plurality of motors 4-12, 4-13, 4-14, 4-15, etc. (generally referred to herein as motors 4), and each motor 4 among the plurality of motors 4 includes a different height and/or length of a motor frame size that corresponds to a different matching motor plate 6.

Each of the plurality of motors 4-12, 4-13, 4-14, 4-15 is paired with a one of a plurality of motor-plates 6-12, 6-13, 6-14, 6-15, etc. (generally referred to herein as motor-plates 6) to form a plurality of various combinations of motor-plate assemblies 24. The inverse height relationship between the each of the plurality of motors 4 and each of the different matching motor-plates 6 can form different motor-plate assemblies 24 with a centerline 30 of the motor shaft aligning with the direct drive fan assembly 2.

In some embodiments, changing the motor 4 to a different motor 4 may occur, which may result in changing the motor plate 6 to a different motor plate 6 in response to the changed motor 4. That is, the motor plate 6 is dependent upon a selected motor 4. The different motor 4 may be matched to a different motor plate 6 to create a different motor-plate assembly 24. Various combinations of motor-plate assemblies can be formed in such a manner.

While each motor 4 and the motor plate 6 may vary in height, the motor-plate assembly 24 can have a resulting height H2, which is the sum from the base of the motor plate 6 to the centerline 30 of the motor 4. The predetermined particular height H1 of the direct drive fan assembly 2 is a constant distance (e.g., center of hub 8 in FIG. 1 to top of motor plate 20). As such, the resulting height H2 of the motor-plate assembly 24 is equal to the particular height H1 (H2=H1) such that the centerline 30 aligns with the direct drive fan assembly 2.

Each of the various combinations of motor-plate assemblies 24 can be received on the placement area 26 of the direct drive fan assembly 2, as previously described with respect to FIG. 4A. The direct drive fan assembly 2 may receive one of the motor-plate assemblies on the placement area 26 and function without additional changes to the frame or support components of the direct drive fan assembly 2 because the centerline 30 of the motor shaft of the motor-plate assembly 24 aligns with the direct drive fan assembly 2.

Figure 6:
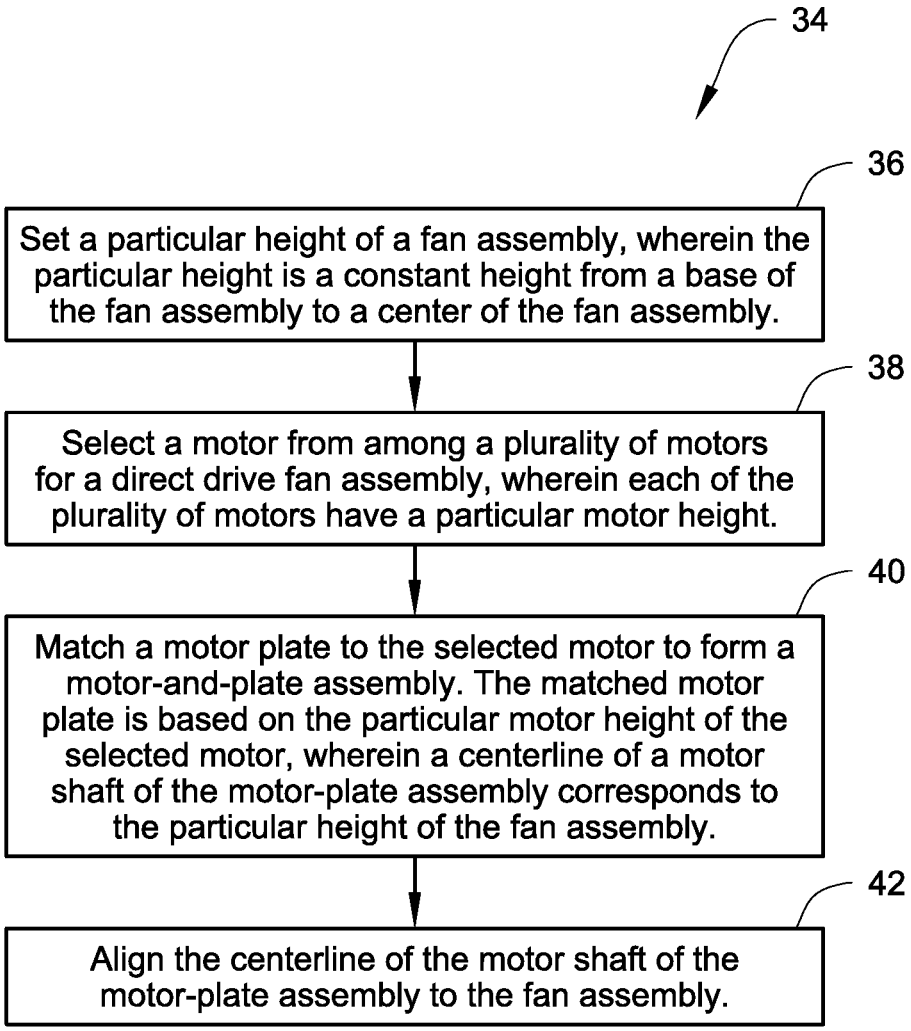
FIG. 6 illustrates a method flowchart of an embodiment of the disclosure.

FIG. 6 illustrates a method flow chart of an embodiment of the disclosure. The method 34 describes aligning a centerline of a motor shaft in a direct drive fan assembly while minimizing components.

At box 36, the method 34 includes setting a particular height H1 of a direct drive fan assembly, wherein the particular height is a constant height from a base of the direct drive fan assembly to a center of the direct drive fan assembly. The particular height H1 is measured from a top of a motor support to a center of a hub of a direct drive fan assembly. The particular height H1 can be based on a largest motor size available that the direct drive fan assembly can accommodate.

At box 38, the method 34 includes selecting a motor from among a plurality of motors for a direct drive fan assembly. For instance, the selected motor can be a tall motor or a short motor, depending upon the specific direct drive fan assembly. Each of the plurality of motors has a particular motor height. The particular motor height can correspond to the size of the selected motor. For example, a larger motor can be taller than a smaller motor, which may be shorter.

At box 40, the method 34 includes matching a motor plate to the selected motor to form a motor and plate assembly, the matched motor plate is based on the particular motor height of the selected motor. That is, the selected motor determines a corresponding motor-plate. For example, the motor height MH determines which motor plate height PH is matched to form the motor-plate assembly. The resulting height H2 from the centerline of the motor to the base of the motor plate is equal to the particular height H1 of the direct drive fan assembly. As such, the resulting height H2 of the motor-plate assembly is equal to the particular height H1 (H2=H1), such that the centerline is aligned with the direct drive fan assembly for proper operation.

At box 42, the method 34 includes aligning the centerline of the motor shaft of the motor-plate assembly to the direct drive fan assembly. The motor-plate assembly can be installed in the direct drive fan assembly for operation. Many different combinations of motor-plate assemblies can operate within the direct drive fan assembly without replacing additional components of the direct drive fan assembly, as previously described herein.

Aspects

Any of aspects 1-10 can be combined with any of aspects 11-20 and any of aspects 11-16 can be combined with any of aspects 17-20.

Aspect 1. A method for aligning a centerline of a motor shaft in a direct drive fan assembly, the direct drive fan assembly includes a motor, a motor shaft, and a fan, comprising:

selecting a motor from among a plurality of motors;

matching a motor plate from among a plurality of motor plates to the motor, the matched motor plate is based on the selected motor, creating, from the selected motor and the matching motor plate, a motor-plate assembly that has a resulting height, wherein the resulting height of the motor-plate assembly corresponds to a particular height of a direct drive fan assembly;

aligning a centerline of a motor shaft of the motor-plate assembly to the direct drive fan assembly, wherein the particular height of the direct drive fan assembly is constant.

Aspect 2. The method of aspect 1, wherein:

each motor among the plurality of motors has a particular motor height, each motor plate among the plurality of motor plates has a particular motor plate height, and wherein the particular motor height of the selected motor inversely corresponds to the particular plate height of the matching motor plate.

Aspect 3. The method of aspects 1 or 2, wherein the plurality of motors and the plurality of motor plates form a plurality of different motor-plate assemblies, each of the different motor-plate assemblies has the resulting height that corresponds to the particular height of the direct drive fan assembly.

Aspect 4. The method of any of aspects 1-3, further comprising lowering the motor-plate assembly, via a notch on each motor support in the direct drive fan assembly, when the motor-plate assembly exceeds the particular height of the direct drive fan assembly.

Aspect 5. The method of any of aspects 1-4, wherein the particular height of the direct drive fan assembly is based on a distance from a motor support to a center of a hub, and the resulting height of the motor-plate assembly is based on a distance from a base of the motor plate to the centerline of a motor shaft.

Aspect 6. The method of any of the aspects 1-5, further comprising:

changing the motor to a second motor in the direct drive fan assembly, and changing the motor-plate corresponding to a second motor-plate in the direct drive fan assembly to form a second motor-plate assembly, wherein only the motor and the motor-plate are changed in the direct drive fan assembly, and wherein the second motor-plate assembly has a resulting height equal to the particular height of the direct drive fan assembly.

Aspect 7. The method of any of the aspects 1-6, further comprising:

changing the motor to a different motor, wherein the height of the matching motor-plate increases when the height of the different motor decreases, and/or the height of the matching motor-plate decreases as the different motor increases, wherein the matching motor-plate height is inversely related to the height of the motor, such that a distance from the centerline of the motor shaft to the base of the motor plate corresponds to the particular height of the direct drive fan assembly.

Aspect 8. The method of any of the aspects 1-7, further comprising receiving the motor-plate assembly on a placement area of the direct drive fan assembly, wherein the direct drive fan assembly frame includes a frame with a plurality of components in a fixed arrangement.

Aspect 9. The method of any of the aspects 1-8, wherein the centerline is a center of the motor shaft of the motor, and the centerline aligns with, and connects to, a hub of the direct drive fan assembly.

Aspect 10. The method of any of the aspects 1-9, further comprising setting the particular height of the direct drive fan assembly based on a maximum motor size, wherein the particular height of the direct drive fan assembly determines the resulting height of the motor-plate assembly.

Aspect 11. A method for minimizing components in a direct drive fan assembly, comprising:

setting a particular height of a direct drive fan assembly, wherein the particular height is a constant height from a base of the direct drive fan assembly to a center of a hub of the direct drive fan assembly;

selecting a motor from among a plurality of motors for a direct drive fan assembly, wherein each of the plurality of motors has a particular motor height;

matching a motor plate to the selected motor to form a motor-plate assembly having a resulting height, the matched motor plate is based on the particular motor height of the selected motor, wherein the resulting height of the motor-plate assembly is equal to the particular height of the direct drive fan assembly;

aligning the centerline of the motor shaft of the motor-plate assembly to the direct drive fan assembly.

Aspect 12. The method of aspect 11, further comprising matching each of the plurality of motors different particular motor heights to a particular motor plate with a different motor plate height, and creating a plurality of motor and plate assemblies from various combinations of the motor and matching motor plates, wherein each of the plurality of motor-plate assemblies has the resulting height that is equal to the particular height of the direct drive fan assembly and aligns the centerline of the motor shaft to the direct drive fan assembly.

Aspect 13. The method of aspects 11 or 12, wherein the matching motor-plate includes a motor plate height that is inversely related to the particular motor height of the motor, such that a distance from the centerline of the motor shaft to the base of the motor plate corresponds to the particular height of the direct drive fan assembly.

Aspect 14. The method of any of the aspects 11-13, further comprising:

changing the motor to a different motor;

changing the motor plate to a different motor plate in response to the changed motor; matching the different motor to the different motor plate to create a different motor-plate assembly;

lowering the different motor-plate assembly, via a notch in each motor support of the direct drive fan assembly, wherein the different motor-plate assembly includes a second resulting height;

aligning the centerline of the different motor-plate assembly on the direct drive fan assembly;

wherein the second resulting height is equal to the particular height of the direct drive fan assembly.

Aspect 15. The method of aspect 14, wherein the direct drive fan assembly includes a frame with components that remain in a fixed arrangement even when the motor-plate assembly is changed.

Aspect 16. The method of any of the aspects 11-15, further comprising lowering the motor-plate assembly via a notch in each motor support of the direct drive fan assembly to accommodate a different motor that exceeds a motor threshold height.

Aspect 17. A direct drive fan assembly, comprising:

a direct drive fan assembly frame that includes a motor support and a hub connected to the frame;

a motor-plate assembly that includes a motor with a motor shaft and matching motor plate, wherein the motor-plate assembly is connected to the motor support of the direct drive fan assembly;

a particular height for the direct drive fan assembly, wherein the particular height is measured from a top of the motor support to a center of the hub;

a resulting height for the motor-plate assembly, wherein the resulting height is measured from a base of the motor-plate to a center of the motor shaft;

wherein the resulting height of the motor assembly corresponds to the particular height of the direct drive fan assembly.

Aspect 18. The direct drive fan assembly of aspect 17, further comprising a notch in the base frame, wherein the notch lowers the motor-plate assembly and increases the particular height by a distance.

Aspect 19. The direct drive fan assembly of aspects 17 or 18, wherein the motor-plate assembly includes a centerline of a motor shaft that is aligned and connected to the direct drive fan based on the assembly corresponding to the particular height of the direct drive fan assembly.

Aspect 20. The direct drive fan assembly of any of the aspects 17-19, wherein the motor and the matching motor plate have an inverse size relationship.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. The word "embodiment" as used within this Specification may, but does not necessarily, refer to the same embodiment. This Specification and the embodiments described are exemplary only. Other and further embodiments may be devised without departing from the basic scope thereof, with the true scope and spirit of the disclosure being indicated by the claims that follow.

What is claimed is:

1. A method for aligning a centerline of a motor shaft in a direct drive fan assembly, the direct drive fan assembly includes a motor, two motor supports each having a vertical side with a notch, a motor shaft, and a fan, comprising:

selecting the motor from among a plurality of motors, the plurality of motors having different heights;

matching a motor plate from among a plurality of motor plates to the selected motor, the matching motor plate being a single integral piece and including flanges, the plurality of the motor plates having different heights;

creating, from the selected motor and the matching motor plate, a motor-plate assembly having a resulting height that matches a particular height of the direct drive fan assembly, the motor-plate assembly being created by directly attaching the selected motor to the matching motor plate;

lowering the motor-plate assembly by inserting the flanges of the matching motor plate into the notches in the two motor supports which increases the particular height of the direct drive fan assembly by a distance, when the particular height of the selected motor exceeds a motor threshold height; and aligning the centerline of the motor shaft of the motor-plate assembly to the direct drive fan assembly, and the plurality of motors and the plurality of motor plates are sized such that each motor in the plurality of motors matches with one of the plurality of motor plates to create a respective motor-plate assembly having a resulting height that matches the particular height of the direct drive fan assembly, wherein the particular height of the direct drive fan assembly is based on a distance from the motor support to a center of a hub of the direct drive fan assembly.

2. The method of claim 1, wherein:

each motor among the plurality of motors has a particular motor height, each motor plate among the plurality of motor plates has a particular motor plate height, and wherein the particular motor height of the selected motor inversely corresponds to the particular plate height of the matching motor plate.

3. The method of claim 2, wherein the plurality of motors and the plurality of motor plates form a plurality of different motor-plate assemblies, each of the different motor-plate assemblies has the resulting height that matches the particular height of the direct drive fan assembly.

4. The method of claim 1, wherein the resulting height of the motor-plate assembly is based on a distance from a base of the motor plate to the centerline of the motor shaft.

5. The method of claim 1, further comprising:

changing the motor in the direct drive fan assembly to a second motor of the plurality of motors, and changing the motor-plate in the direct drive fan assembly to a second motor-plate of the plurality of motor plates that matches the second motor to form a second motor-plate assembly, wherein only the motor and the motor-plate are changed in the direct drive fan assembly, and wherein the second motor-plate assembly has a resulting height equal to the particular height of the direct drive fan assembly.

6. The method of claim 1, further comprising:

changing the motor to a different motor of the plurality of motors, wherein the height of the matching motor-plate increases when the height of the different motor decreases, or the height of the matching motor-plate decreases as the height of the different motor increases, wherein the height of the matching motor-plate is inversely related to the height of the motor, such that a distance from the centerline of the motor shaft to a base of the motor plate matches the particular height of the direct drive fan assembly.

7. The method of claim 1, further comprising:

receiving the motor-plate assembly on a placement area of the direct drive fan assembly, wherein the direct drive fan assembly includes a frame with a plurality of components in a fixed arrangement.

8. The method of claim 1, wherein the centerline is a center of the motor shaft of the motor, and the centerline aligns with, and connects to, a hub of the direct drive fan assembly.

9. The method of claim 1, further comprising:

setting the particular height of the direct drive fan assembly based on a maximum motor size, wherein the particular height of the direct drive fan assembly determines the resulting height of the motor-plate assembly.

10. A method for minimizing components in a direct drive fan assembly, the direct drive fan assembly includes two motor supports each including a vertical side with a notch, the method comprising:

setting a particular height of the direct drive fan assembly, wherein the particular height is a height from a base of the direct drive fan assembly to a center of a hub of the direct drive fan assembly;

selecting a motor from among a plurality of motors for the direct drive fan assembly, wherein each of the plurality of motors has a particular motor height;

matching a motor plate from among a plurality of motor plates to the selected motor to form a motor-plate assembly having a resulting height that matches the particular height of the direct drive fan assembly, the matching motor plate being a single integral piece and including flanges, the plurality of the motor plates having different heights, the motor-plate assembly being formed by directly attaching the selected motor to the matching motor plate, and the motor plate matching based on the particular motor height of the selected motor;

lowering the motor-plate assembly by inserting the flanges of the matching motor plate into the notches in the two motor supports which increases the particular height of the direct drive assembly by a distance, when the particular height of the selected motor exceeds a motor threshold height; and aligning a centerline of a motor shaft of the motor-plate assembly to the direct drive fan assembly, wherein the plurality of motors and the plurality of motor plates are sized such that each motor in the plurality of motors matches with one of the plurality of motor plates to create a respective motor-plate assembly having a resulting height that matches the particular height of the direct drive fan assembly.

11. The method of claim 10, further comprising:

matching each of the plurality of motors different particular motor heights to a particular motor plate with a different motor plate height, and creating a plurality of motor-plate assemblies from various combinations of the motor and matching motor plates, wherein each of the plurality of motor-plate assemblies has the resulting height that is equal to the particular height of the direct drive fan assembly and aligns the centerline of the motor shaft to the direct drive fan assembly.

12. The method of claim 10, wherein the matching motor-plate includes a motor plate height that is inversely related to the particular motor height of the motor, such that a distance from the centerline of the motor shaft to a base of the motor plate matches the particular height of the direct drive fan assembly.

13. The method of claim 10, further comprising:

changing the motor in the direct drive assembly to a different motor of the plurality of motors;

changing the motor plate to a different motor plate of the plurality of motor plates in response to the changed motor, the different motor plate including flanges;

matching the different motor to the different motor plate to create a different motor-plate assembly;

lowering the different motor-plate assembly by inserting the flanges of the different motor plate into the notches in the two motor supports, wherein the different motor-plate assembly includes a second resulting height; and aligning a centerline of the different motor-plate assembly on the direct drive fan assembly;

wherein the second resulting height is equal to the particular height of the direct drive fan assembly.

14. The method of claim 13, wherein the direct drive fan assembly includes a frame with components that remain in a fixed arrangement even when the motor-plate assembly is changed.

15. A direct drive fan assembly, comprising:

a direct drive fan assembly frame that includes two motor supports and a hub connected to the frame, each of the two motor supports having a vertical side with a notch;

a motor-plate assembly selected from a plurality of motor-plate assemblies that includes a motor selected from a plurality of motors with a motor shaft and a matching motor plate selected from a plurality of motor plates, the motor being directly attached to the matching motor plate in the motor-plate assembly, the matching motor plate being a single integral piece and including flanges, the plurality of motor plates having different heights, and the motor-plate assembly connected to the two motor supports of the direct drive fan assembly;

a particular height for the direct drive fan assembly, wherein the particular height is measured from a top of the two motor supports to a center of the hub; and a resulting height for the motor-plate assembly matches the particular height of the direct drive fan assembly, the resulting height measured from a base of the motor-plate to a center of the motor shaft, wherein the direct drive fan assembly is configured such that, when selected, each motor of the plurality of motors attaches to the two motor supports with a matching motor plate of the plurality of motor plates, and the motor-plate assembly configured to be lowered by inserting the flanges of the matching motor plate into the notches of the two motor supports which increases the particular height of the direct drive assembly by a distance, when a particular height of the selected motor exceeds a motor threshold height.

16. The direct drive fan assembly of claim 15, wherein a centerline of the motor shaft is aligned to the direct drive fan based on matching the particular height of the direct drive fan assembly.

17. The direct drive fan assembly of claim 15, wherein the motor and the matching motor plate have an inverse size relationship.

* * * * *